United States Patent [19]

Mitchell

[11] Patent Number: 4,461,480

[45] Date of Patent: Jul. 24, 1984

[54] EDUCATIONAL ENTERTAINMENT DEVICE COMPRISING CUBES FORMED OF FOUR ⅛TH OCTAHEDRON SECTIONS ROTATABLY COUPLED TO A TETRAHEDRON

[76] Inventor: Maurice E. Mitchell, 429 Tampico, Walnut Creek, Calif. 94598

[21] Appl. No.: 430,316

[22] Filed: Sep. 30, 1982

[51] Int. Cl.[3] ..... A63F 9/08

[52] U.S. Cl. ..... 273/153 S; 446/128; 446/102; 273/155; 434/215

[58] Field of Search ..... 273/153 S, 155, 157 R; 46/25, 26; 434/211, 215

[56] References Cited

U.S. PATENT DOCUMENTS

| | | | |
|---|---|---|---|
| 1,216,840 | 2/1917 | Ramsey et al. | 46/26 |
| 2,236,926 | 4/1941 | Surface | 46/26 UX |
| 2,839,841 | 6/1958 | Berry | 273/157 R UX |
| 3,081,089 | 3/1963 | Gustafson | 273/155 X |
| 3,289,322 | 12/1966 | Patrick . | |
| 3,645,535 | 2/1972 | Randolph | 273/157 R |
| 3,655,201 | 4/1972 | Nichols | 273/153 R |
| 3,659,360 | 5/1972 | Zeischegg | 273/157 R X |
| 3,953,948 | 5/1976 | Hogan | 46/25 X |
| 4,014,110 | 3/1977 | Mayer . | |
| 4,238,905 | 12/1980 | MacGraw | 46/25 |
| 4,258,479 | 3/1981 | Roane | 434/211 |
| 4,317,654 | 3/1982 | Wahl | 434/211 |

FOREIGN PATENT DOCUMENTS

| | | | |
|---|---|---|---|
| 170062 | 12/1977 | Hungary | 273/153 S |
| 55-3956 | 1/1980 | Japan | 273/153 S |
| 55-8192 | 3/1980 | Japan | 273/153 S |
| 55-8193 | 3/1980 | Japan | 273/153 S |

OTHER PUBLICATIONS

Patent & Trademark Office Inventor's Day handout illustrating polyhedrons, Feb. 7–8, 1976.

Evercheering Enterprise Co., Ltd. advertisement, 6-1-9-81.

Pyraminx ® instruction sheet, copyright 1981.

*Primary Examiner*—Anton O. Oechsle

*Attorney, Agent, or Firm*—William D. Hall; Marc Sandy Block

[57] ABSTRACT

An educational entertainment device includes at least one cube formed from (a) a regular tetrahedron and (b) four ⅛th sections of a regular octahedron wherein the faces of the tetrahedron and the faces of the octahedron are all congruent. The ⅛th sections are formed by slicing the octahedron through three orthogonal planes, each slicing plane passing through four vertices of the octahedron, each ⅛th section being defined by (a) one octahedron face and (b) three mutually orthogonal corner faces. By coupling the octahedron face of each of the four ⅛th sections to a corresponding one of the tetrahedron faces in edge-to-edge fashion, one cube is formed. Each side of the cube includes two corner faces, one from each of two ⅛th sections. By rotating a ⅛th section about an axis perpendicular to the plane interfacing the ⅛th section and the tetrahedron, the two corner faces forming a cube side can be altered. A plurality of $n^3$, e.g. eight, cubes can form a block of cubes, in an $n \times n \times n$ arrangement of cubes. Indicia may be applied to the corner faces of the cubes so that each face of the block has prescribed indicia thereon when (a) all of the ⅛th sections on each cube are rotated in a prescribed fashion and (b) the cubes are arranged relative to each other in a predefined manner. The block, in addition to entertainment use, can be used to show seven planes in space and the nature of the tetrahedron and octahedron as basic structures.

12 Claims, 8 Drawing Figures

FIG. 5
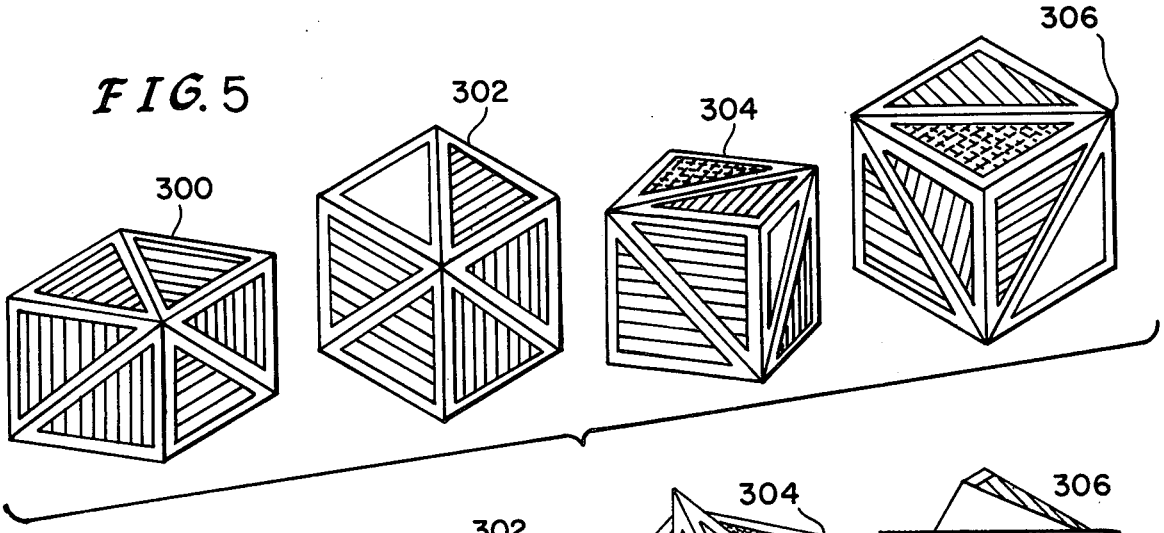
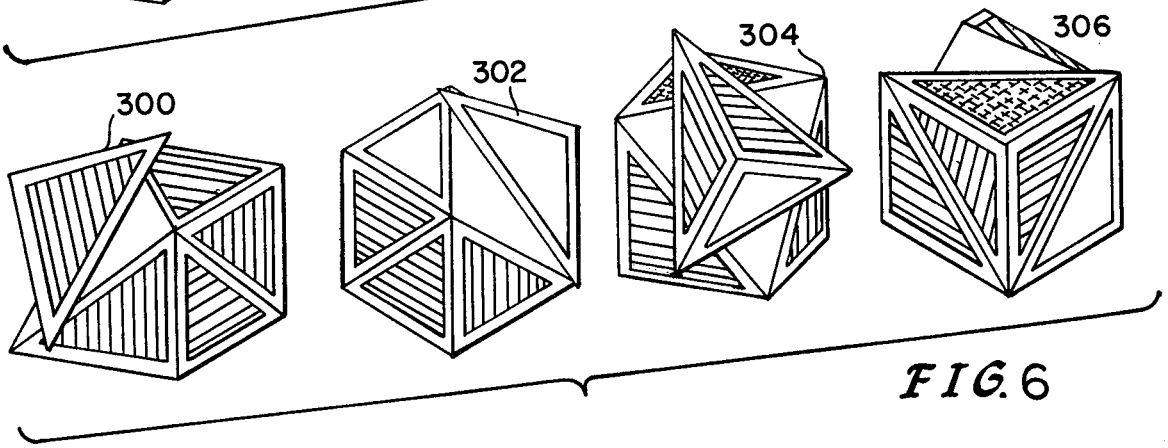
FIG. 6
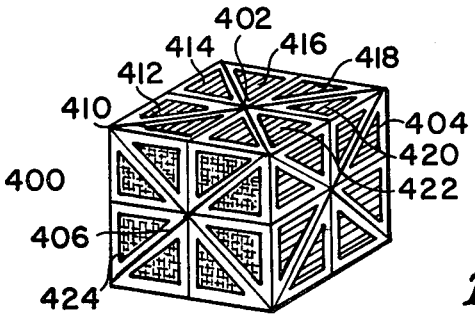
FIG. 7
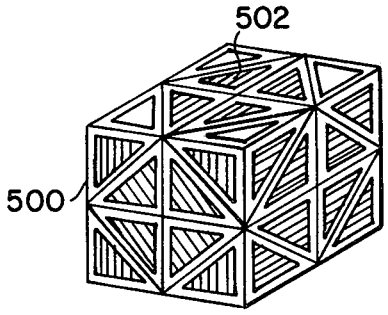
FIG. 8

EDUCATIONAL ENTERTAINMENT DEVICE COMPRISING CUBES FORMED OF FOUR $\frac{1}{8}$TH OCTAHEDRON SECTIONS ROTATABLY COUPLED TO A TETRAHEDRON In the past and concurrent with the present invention, numerous geometric puzzles and educational devices have been disclosed. These devices generally provide for the rotation of geometric shapes, that are somehow linked together, about three distinct axes. Accordingly, such devices—if viewed as educational tools—have been limited to showing three planes, which conforms to the standard approach of viewing three-dimensional space. The notion of examining space in more planes is not and has not been suggested by such devices. Specifically, the viewing of space in seven planes remains undisclosed by prior or contemporaneous art.

Moreover, although there are numerous discussions of geometric shapes and space occupied by geometric shapes, it has never been suggested that tetrahedrons and octahedrons alone can be combined to fill space. Hence, no existing devices have been disclosed which teach this interrelationship.

Further, no prior or current technology teaches a structure rotatable about seven distinct axes or a structure in which constituent elements can be rotated to expose seven planes.

Still further, the prior teachings do not provide a puzzle in which faces a block are to be changed—through selective rotation of the constituent elements about one of the seven axes—to provide predefined patterns of indicia on the block faces.

SUMMARY OF THE INVENTION

The present invention relates to a device which simultaneously entertains and educates. Specifically, the device includes at least one cube which is formed by combining four $\frac{1}{8}$th sections of an octahedron—each $\frac{1}{8}$th section including one of the octahedron faces and three mutually orthogonal corner faces—and a tetrahedron where the tetrahedron faces and the octahedron faces are congruent. Abutting each tetrahedron face is the octahedron face of a corresponding one of the $\frac{1}{8}$th sections. Each $\frac{1}{8}$th section is rotatable relative to the tetrahedron about an axis perpendicular to the plane of the abutting octahedron and tetrahedron faces. Each $\frac{1}{8}$th section, it is noted, rotates about a distinct axis (perpendicular to the abutting tetrahedron face). It is thus an object of the invention to provide a cube device which permits rotation of $\frac{1}{8}$th sections thereof about four distinct axes. It is an associated object as well to provide a device which clearly exposes one of four distinct planes in space as a corresponding $\frac{1}{8}$th section is rotated.

By stacking eight cubes into a $2\times2\times2$ array, a block of cubes is formed. Each face of the block is defined by four cubes disposed along one of three orthogonal planes. The cubes along each face of the block are rotatable about a respective axis which is perpendicular to the plane of the block face. It is thus a further object of the invention to provide a block of cubes wherein (a) the faces of the block are rotatable about three distinct axes and (b) the cubes themselves include $\frac{1}{8}$th sections rotatable about four distinct axes, the block thereby including elements rotatable about seven distinct axes. A related object of the invention is the inclusion of seven distinct planes defined and clearly viewable within the block.

Further, it is an object of the invention to demonstrate that tetrahedrons and octahedrons can be combined to form a space-filling structure.

The above objects are enhanced and the object of providing a uniquely difficult to solve geometric puzzle is achieved by selectively applying identifying indicia to the various corner faces of each cube so that each face of the block has a predetermined pattern of indicia thereon when (a) the cubes are stacked in a prescribed fashion and (b) the corner faces of each cube are rotated in a prescribed fashion. There is thus a dual object of matching each face with its desired pattern while rotating constituent elements of the block about seven distinct axes to achieve the desired pattern. It is, of course, a related object to provide a single unique solution or desired pattern of indicia on the block faces—the prescribed fashion of stacking and the prescribed fashion of rotating the cubes each being singular and unique.

DESCRIPTION OF THE DRAWINGS

FIG. 5 is an illustration showing four cubes, each comprising a tetrahedron and four $\frac{1}{8}$th sections of an octahedron coupled thereto.

FIG. 6 is an illustration showing the four cubes of FIG. 5 modified by rotating one of the $\frac{1}{8}$th sections relative to the tetrahedron.

FIG. 7 is an illustration of one embodiment of the invention showing eight cubes of FIG. 5 stacked to form a block of cubes, each face of the block having a uniform indicia thereon.

FIG. 8 is an illustration of another embodiment of the invention showing eight cubes of FIG. 5 stacked to form a block of cubes, each face of the block having a predefined pattern thereon.

DESCRIPTION OF THE INVENTION

Description of the Cube

Figure 1:
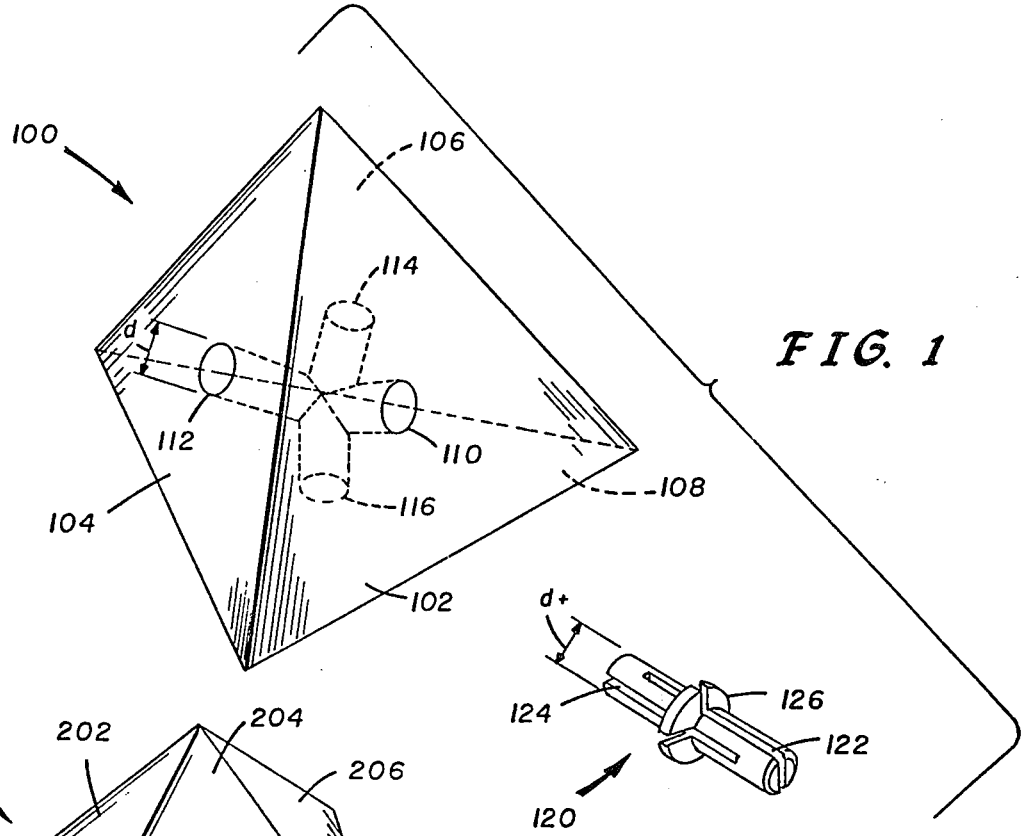
FIG. 1 is an illustration of a regular tetrahedron.

Referring to FIG. 1, a regular tetrahedron 100, i.e. a tetrahedron with four congruent faces 102 through 108 each of which comprises an equilateral triangle, is shown. Perpendicular to each face 102 through 108 and preferably centrally located thereon is a respective aperture 110 through 116. Also preferably, the apertures 110 through 116 are cylindrical in shape having a diameter d.

Insertable into each aperture 110 through 116 is a generally cylindrical coupling element 120 which has a diameter d+ which is slightly larger than d. Disposed lengthwise in the coupling element 120 are slits 122 and 124. When radial pressure is applied to either end of the coupling element 120, the end is reduced in cross-section sufficiently to permit the end to enter one of the apertures 110 through 116. As the end is pressed radially inwardly, a spring force results so that the coupling element 120 effects a tight fit when inserted into one of the apertures 110 through 116. Approximately midway along the coupling element 120 is a flanged portion 126 which limits the penetration of the coupling element 120 into the tetrahedron 100. Moreover, the apertures 110 through 116 and coupling elements 120 are dimensioned in length so that a plurality of coupling elements 120, e.g. four, are insertable into the tetrahedron 100 at the same time.

Figure 2:
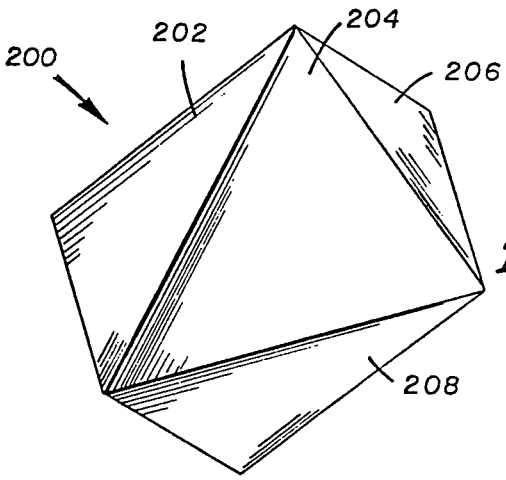
FIG. 2 is an illustration showing a regular octahedron.
Figure 3:
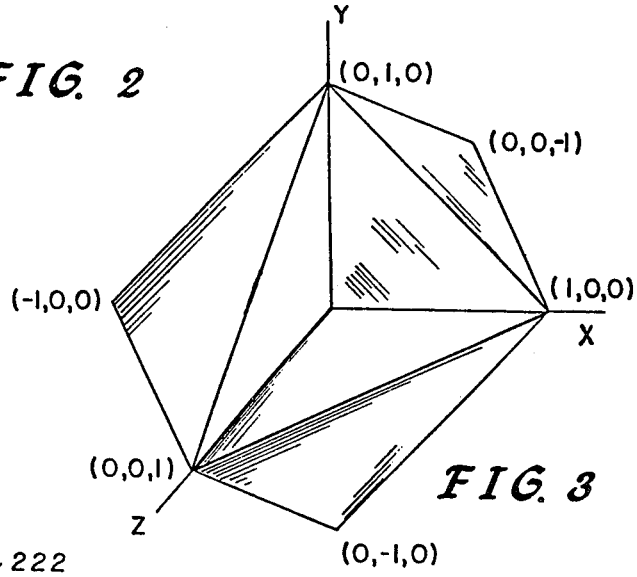
FIG. 3 is an illustration showing a regular octahedron in an xyz-coordinate system.

Referring now to FIG. 2, a regular octahedron 200, i.e. an octahedron having eight congruent octahedron faces each of which defines an equilateral triangle, is shown (only faces 202 through 208 being visible). To better envision the structure of the octahedron 200, an xyz coordinate system is included in FIG. 3. The center of the octahedron 200 is located at the origin with each of the six vertices being at a unit length from the origin along the three axes.

Figure 4:
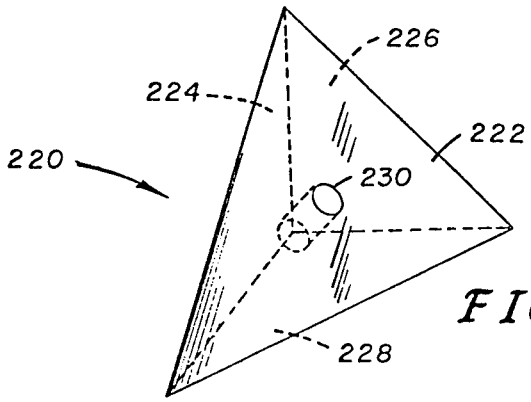
FIG. 4 is an illustration of a $\frac{1}{8}$th section of the regular octahedron formed by slicing the octahedron with three orthogonal planes, each plane passing through four vertices of the octahedron.

In accordance with the invention, four ⅛th sections of the octahedron 200 are coupled to the tetrahedron 100 of FIG. 1 to form a cube. The ⅛th sections are generated by slicing the octahedron 200 with the x-plane, the y-plane, and the z-plane. Each such plane, it is noted, passes through four vertices. By so slicing the octahedron 200, eight identical ⅛th sections, such as ⅛th section 220 of FIG. 4, are generated. Each ⅛th section 220 thus comprises an octahedron face 222 and three corner faces 224, 226, and 228. Each coner face 224 through 228 lies along a respective one of the three slicing planes. Accordingly, the corner faces 224 through 228 are mutually orthogonal, forming a 90° corner. Extending inwardly and perpendicularly to the octahedron face 222 is an aperture 230 of diameter d. Hence, the octahedron face 222 can be coupled against a tetrahedron face, such as face 102, with a coupling element 120 (see FIG. 1). The edge length of each side of the tetrahedron face 102 equal, so the two faces are alignable edge-to-edge. Further, because the coupling element 120 permits relative rotation, each ⅛th section can be rotated to any one of three edge-to-edge alignments relative to the tetrahedron face against which such ⅛th section abuts.

In FIG. 5, four cubes 300, 302, 304 and 306 are illustrated. Each of the cubes 300 through 306 includes a tetrahedron (such as tetrahedron 100) with four ⅛th sections (such as section 220) being coupled thereto, each tetrahedron face having an octahedron face lying thereagainst in edge-to-edge alignment. (The corner faces of each cube 300 through 306, it is noted, have indicia provided thereon.)

In FIG. 6, various ⅛th sections are rotated relative to the tetrahedrons to modify the cubes 300 through 306. FIG. 6 shows that rotating each ⅛th section results in rotation about a distinct axis. Similarly, the rotation of each ⅛th section exposes a tetrahedron face which lies along a distinct plane. Specifically, four distinct rotational axes and four distinct planes are observable by rotating the various ⅛th sections.

Description of the Block Formed of Cubes

FIG. 7 shows a block 400 of eight cubes, such as cubes 300 through 306. The block 400 has six faces, three of which are visible. Each of the three faces 402, 404, and 406 are shown to be formed of eight corner faces of four cubes. Block face 402, for example, is defined by corner faces 410 through 424. Notably, the corner faces are definable as pairs, each pair being constituent elements of the same cube. That is, corner face pairs 412, 414 and 416, 418 and 420,422 and 424,410 are constituent elements of four respective cubes.

In FIG. 7, each block face 402, 404, and 406 has a uniform identifying indicia—i.e. a color or shade—thereon. Block face 402 is uniformly light while block faces 404 and 406 are dark. Preferably, block faces 404 and 406 are different in color and shade.

An examination of FIGS. 6 and 7 shows that the block faces 402 through 406 can be changed in various ways. First, four cubes which define a block face can be rotated about an axis perpendicular to the block face. Notably, rotation of the block faces about three orthogonal axes can be effected. Each rotation exposes a corresponding plane. Second, as discussed with reference to the cubes, the four ⅛th sections in each cube can be rotated about distinct respective axes to expose corresponding planes. In this regard, it is noted that each corner face on each cube has an indicia applied thereto. The indicia on various corner faces of the cubes differ as desired, depending on the puzzle solution that is preselected. In total then, by either rotating ⅛th sections as suggested by FIG. 6 or by rotating block faces as suggested by FIG. 7, the indicia on the block faces can be varied.

Optionally, only one prescribed, unique manner of rotating the elements of the block 40 will yield a desired pattern of indicia on the block faces. That is, each ⅛th section of each cube must be properly rotated and each cube must be properly stacked and oriented in the block 400 to yield the desired block face pattern.

Alternatively, a plurality of arrangements of block face patterns may be selected as solutions. In FIG. 8, a block 500 is shown made of eight cubes. The block face 502 does not have uniform indicia thereon, however the block face pattern illustrated may be a selected solution. For holding the faces of the block 400 or 500 together while permitting rotation of each face about an axis extending perpendicularly through the center thereof, each corner face may be magnetic. In that way, the four cubes in a given face can be rotated en masse while still permitting each cube to be individually withdrawn for rotation of a corresponding ⅛th section thereon.

By manipulating the blocks 400 and 500, (a) the interplay between tetrahedrons and octahedrons, (b) the defining of seven planes (or rotational axes) in space, (c) the filling of space by tetrahedron and octahedrons, and (d) the satisfaction of solving a complex puzzle are simultaneously achieved.

It should be noted that the various tetrahedrons, octahedron ⅛th sections, and coupling elements may comprise any of various materials, such as but not limited to plastic, wood, paper or metal.

Other improvements, modifications and embodiments will become apparent to one of ordinary skill in the art upon review of this disclosure. Such improvements, modifications and embodiments are considered to be within the scope of this invention as defined by the following claims.

I claim:

1. A method for making an educational puzzle comprising the step of producing at least one cube, wherein the producing of each cube includes the steps of:

forming four equal ⅛th sections of a regular octahedron, the forming step comprising the step of extracting four ⅛th sections from a regular octahedron sliced through three orthogonal planes, where each plane passes through four vertices of the octahedron, each ⅛th section thereby having (a) one octahedron face and (b) three corner faces each of which lies along a corresponding one of the orthogonal planes; and rotatably coupling the octahedron face of each of the four formed $\frac{1}{8}$th sections to a corresponding face of a regular tetrahedron, wherein (a) each octahedron face of a respective $\frac{1}{8}$th section is dimensionally congruent with the corresponding face of the regular tetrahedron, and (b) each octahedron face rotates relative to the corresponding tetrahedron face about an axis at least substantially perpendicular to said each octahedron face and said corresponding tetrahedron face.

2. A method according to claim 1 wherein the coupling step comprises the step of:

extending a respective pivot pin perpendicularly outward from the center of each tetrahedron face and perpendicularly into the octahedron face corresponding to said each tetrahedron face.

3. A method according to claim 1 wherein the cube-making step comprises the additional step of:

forming eight of said cubes.

4. A method according to claim 3 comprising the further step of:

applying selected indicia to each corner face of each $\frac{1}{8}$th section of each said cube in a manner such that the cubes, only when each $\frac{1}{8}$th section is rotated to a unique prescribed position, can be stacked to form a unique $2\times2>2$ block in which each face of the block has a prescribed indicia thereon.

5. A method according to claim 3 comprising the further step of:

applying selected indicia to each corner face of each $\frac{1}{8}$th section of each said cube in a manner such that the cubes, only when each $\frac{1}{8}$th section is rotated in a unique prescribed position, can be stacked to form a unique $2\times2\times2$ block in which each face of the block has a uniform indicia thereon, the uniform indicia on each side of the block differing from the uniform indicia on at least one other side.

6. A method according to claim 4 wherein the applying step comprises the steps of:

configuring said eight cubes into a $2\times2\times2$ block;

selecting a distinct prescribed indicia pattern for each face of the block; and identifying each corner face on a respective face of the block with the indicia required for providing the prescribed indicia pattern for the respective face.

7. A method according to claim 5 wherein the applying step comprises the steps of:

configuring said eight cubes into a $2\times2\times2$ block;

selecting a distinct prescribed indicia pattern for each face of the block; and identifying each corner face on a respective face of the block with the indicia required for providing the prescribed indicia pattern for the respective face.

8. A method according to claim 6 wherein the indicia pattern selecting step includes the step of:

defining each prescribed indicia pattern as a uniform pattern on each block face.

9. An educational device comprising:

at least one cube which comprises:

a regular tetrahedron;

four $\frac{1}{8}$th sections of a regular octahedron, wherein the faces of the octahedron are congruent with the faces of the tetrahedron and wherein each section comprises (a) one of the octahedron faces and (b) three orthogonal corner faces formed by slicing the octahedron by three orthogonal planes each plane of which passes through four octahedron vertices, each corner face lying along one of the orthogonal planes; and means for rotatably coupling the octahedron face of each of the four $\frac{1}{8}$th sections to a corresponding one of the tetrahedron faces in a face-to-face relationship.

10. A device according to claim 9 further comprising eight of said cubes arrangeable into a $2\times2\times2$ block of cubes, and wherein the four cubes along each of the six faces of the block are rotatable en masse about an axis extending perpendicularly through the center of said each face.

11. A device according to claim 10 wherein each corner face has a prescribed indicia thereon, the prescribed indicia being selected such that by (a) rotating each $\frac{1}{8}$th section of each cube relative to the respective tetrahedron to a prescribed position and (b) rotating the four cubes along each of the six faces to place said cubes in predefined respective positions, a preselected indicia pattern is provided on each block face.

12. A device according to claim 9 further comprising eight of said cubes arrangeable into a $2\times2\times2$ block of cubes and wherein the cubes in the block are interchangeable and reorientable therein; and wherein each corner face has a prescribed indicia thereon, the prescribed indicia being selected such that by (a) rotating each $\frac{1}{8}$th section of each cube relative to the respective tetrahedron to a prescribed position and (b) arranging the cubes along the six faces into predefined respective positions and orientations, a preselected indicia pattern is provided on each block face.

* * * * *